US005696426A

United States Patent [19]

Antonis et al.

[11] Patent Number: 5,696,426

[45] Date of Patent: Dec. 9, 1997

[54] LIGHTING UNIT, ELECTRODELESS LOW-PRESSURE DISCHARGE LAMP, AND DISCHARGE VESSEL

[75] Inventors: Petrus H. Antonis, Eindhoven, Netherlands; Pieter Postma, Aachen, Germany

[73] Assignee: U.S. Philips Corporation, New York, N.Y.

[21] Appl. No.: 592,220

[22] Filed: Jan. 26, 1996

[30] Foreign Application Priority Data

Feb. 10, 1995 [EP] European Pat. Off. ..... 95200321

[51] Int. Cl.[6] ..... H01J 1/62; H01J 63/04

[52] U.S. Cl. ..... 313/485; 313/486; 313/487

[58] Field of Search ..... 313/485, 486, 313/487, 490, 491, 493; 315/248, 249; 252/301.4 R

[56] References Cited

U.S. PATENT DOCUMENTS

| | | | |
|---|---|---|---|
| 4,001,628 | 1/1977 | Ryan | 313/493 X |
| 4,070,598 | 1/1978 | DeLuca et al. | 313/487 |
| 4,099,090 | 7/1978 | Corth et al. | 313/493 X |
| 4,357,559 | 11/1982 | Piper | 313/487 X |
| 5,006,752 | 4/1991 | Eggink et al. | 313/161 |
| 5,105,122 | 4/1992 | Kowings et al. | 313/487 |

*Primary Examiner*—Sandra L. O'Shea
*Assistant Examiner*—Mack Haynes
*Attorney, Agent, or Firm*—Walter M. Egbert

[57] ABSTRACT

A lighting unit according to the invention comprises an electrodeless low-pressure discharge lamp and a high-frequency supply. The electrodeless low-pressure discharge lamp is provided with a discharge vessel which is closed in a gastight manner, comprises an ionizable filling, and has an enveloping portion and a recessed portion surrounded by the enveloping portion, which enveloping and recessed portions of the discharge vessel each support a luminescent layer. The electrodeless low-pressure discharge lamp is in addition provided with a coil which is arranged in the recessed portion of the discharge vessel and which is electrically connected to the supply. The conversion efficiency of the luminescent layer on the recessed portion is relatively high compared with that of the luminescent layer on the enveloping portion. This measure renders possible a lower temperature of the core.

19 Claims, 1 Drawing Sheet

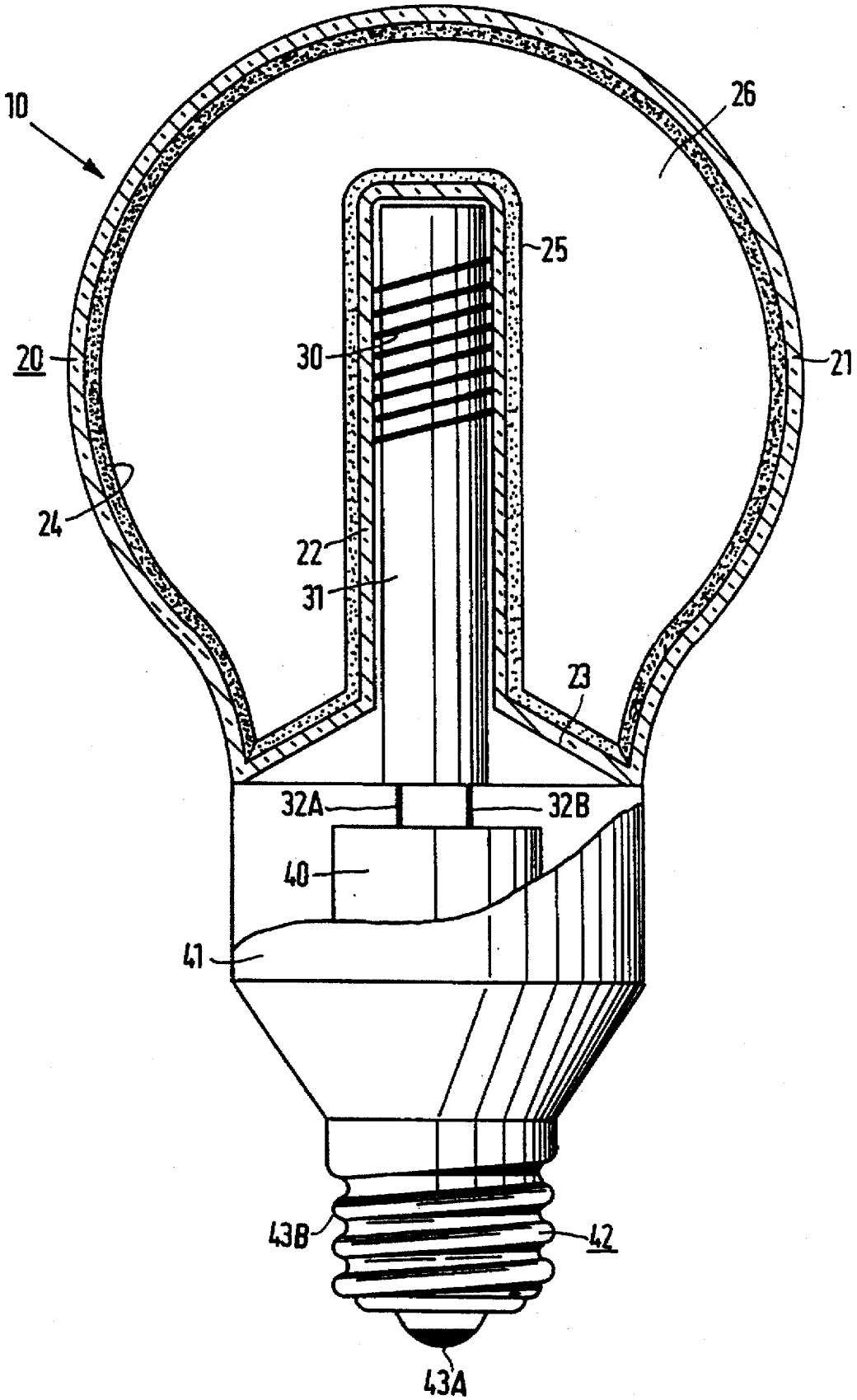
10
26
25
20
30
21
24
22
31
23
32A
32B
40
41
43B
42
43A

LIGHTING UNIT, ELECTRODELESS LOW-PRESSURE DISCHARGE LAMP, AND DISCHARGE VESSEL

BACKGROUND OF THE INVENTION

The invention relates to a lighting unit comprising an electrodeless low-pressure discharge lamp and a high-frequency supply, which electrodeless low-pressure discharge lamp is provided with a discharge vessel which is closed in a gastight manner, has an ionizable filling, and comprises an enveloping portion and a recessed portion surrounded by said enveloping portion, the enveloping and the recessed portion of the discharge vessel each supporting a luminescent layer, and which electrodeless low-pressure discharge lamp is in addition provided with a coil arranged in the recessed portion of the discharge vessel and electrically connected to the supply.

The invention also relates to an electrodeless low-pressure discharge lamp.

The invention also relates to a discharge vessel.

Such a lighting unit is known from U.S. Pat. No. 5,006,752. The discharge vessel of the known lighting unit has a filling of mercury and a rare gas. The supply and the lamp are jointly accommodated in a housing. The coil generates a high-frequency magnetic field during nominal operation for maintaining an electric discharge in a discharge space surrounded by the discharge vessel. UV radiation is created thereby and converted into visible radiation in the luminescent layers. The term "high-frequency" is here understood to mean with a frequency higher than 20 kHz. The frequency of the magnetic field in the known lighting unit is approximately 3 MHz. The coil surrounds a core of soft-magnetic material in which a heat pipe is enclosed for removing heat from the coil and the core to the surroundings of the lamp. As a result, the lamp can be comparatively highly loaded. With an excessively high load, the losses in the core of soft-magnetic material increase strongly, so that even more heat is generated. It is also possible for synthetic resin materials, for example insulation material of a winding around the core, to start melting.

SUMMARY OF THE INVENTION

It is an object of the invention to provide a measure in a lighting unit of the kind described in the opening paragraph which increases the loading possibility of the lamp without the necessity of substantial changes in the construction of the lighting unit.

According to the invention, the lighting unit is for this purpose characterized in that the conversion efficiency of the luminescent layer on the recessed portion is relatively high compared with that of the luminescent layer on the enveloping portion. The conversion from UV radiation to visible radiation in the luminescent layers is not free from losses in practice. The conversion efficiency in the present description and claims is understood to mean the efficiency of the conversion of the excitant UV radiation energy into the emitted visible radiation energy. The conversion efficiency is proportional to the quantum efficiency of the conversion by the luminescent substances in the luminescent layer and to the quotient of the wavelength of the excitant UV radiation and the wavelength of the emitted visible radiation. The energy losses in the conversion are released in the form of heat. The measure according to the invention reduces the heat generation in the luminescent layer on the recessed portion, so that the temperatures prevalent in the recessed portion are reduced.

The measure according to the invention may render a heat conductor in the recessed portion redundant, but may alternatively be applied in combination with such a heat conductor in order to increase the loading possibility of the lamp further. For example, a range of lamps may thus be obtained which have approximately the same dimensions, but whose loading capacities are different.

It is noted that U.S. Pat. No. 5,105,122 discloses a lighting unit comprising an electrodeless low-pressure discharge lamp in which the composition of the luminescent layer on the recessed portion differs from that on the enveloping portion. In this lamp, blue-luminescing material is present exclusively on the enveloping portion of the discharge vessel. The object of this is to limit the shift in colour point of the lamp during lamp life. Given the compositions of the luminescent layers as chosen, however, the conversion efficiency of the luminescent layer on the recessed portion is relatively low here compared with that of the luminescent layer on the enveloping portion.

In a lighting unit according to the invention, which is in addition characterized in that the coil surrounds a core of soft-magnetic material, the inventors have found that a comparatively small difference in conversion efficiency already enables a comparatively great reduction in the temperature of the recessed portion. It is assumed that a self-reinforcing effect plays a part here. In fact, losses also occur in the core of the coil, which losses are greater in proportion as the core temperature is higher. A smaller heat generation in the luminescent layer accordingly also leads to a smaller heat generation in the core.

An attractive embodiment of the lighting unit according to the invention is characterized in that luminescent material whose emission spectrum has a maximum at a wavelength of at least 600 nm is mainly present in the luminescent layer of the enveloping portion. Usual luminescent materials of this type have a comparatively low conversion efficiency.

A comparatively great temperature drop of the coil is realised in an embodiment of the lighting unit according to the invention which is characterized in that luminescent material whose emission spectrum has a maximum at a wavelength of at most 500 nm is mainly present in the luminescent layer of the recessed portion. Usual luminescent materials of this type have a high conversion efficiency compared with luminescent materials whose maximum lies at a greater wavelength.

It is favourable for a further temperature reduction when the luminescent layer of the recessed portion lies on a reflecting layer. It is counteracted thereby that UV radiation transmitted by the luminescent layer of the recessed portion or visible radiation generated in said luminescent layer is absorbed by the recessed portion and leads to heat generation.

A favourable embodiment of the electrodeless low-pressure discharge lamp according to the invention is characterized in that the discharge vessel has an ionizable filling of mercury and a rare gas, and in that the luminescent layer on the recessed portion comprises at least 50% by weight of cerium-magnesium alum hate activated by trivalent terbium (CAT). CAT has a comparatively high conversion efficiency for excitant radiation generated in a low-pressure mercury discharge. It was surprisingly found that lamps according to this embodiment ignite much more readily than lamps whose luminescent layers on the recessed portions comprise said luminescent material to a lesser degree or not at all. A possible explanation is that the luminescent layer of this embodiment of the lamp retains charged particles generated in the discharge space during operation. When an ignition voltage is applied across the coil, the charged particles are released comparatively easily, which promotes the initiation of an electrical discharge.

The coil in the recessed portion can cause a comparatively strong electric field which leads to a comparatively heavy load on the luminescent layer of the recessed portion owing to charged particles from the discharge space which are accelerated under the influence of this field. This may lead to a quicker ageing of luminescent material in the layer. It is very favourable when the luminescent layer on the recessed portion comprises mainly cerium-magnesium aluminate activated by trivalent terbium (CAT). This luminescent material has a comparatively high resistance to the conditions which prevail at the surface of the recessed portion, so that the luminescent layer on the recessed portion can have a long life.

In a further favourable embodiment, the luminescent layer on the recessed portion carries a protective layer made of a metal oxide, for example yttrium oxide or aluminium oxide. This renders it possible to realise a comparatively long life of the luminescent layer on the recessed portion also when comparatively vulnerable luminescent materials are used. A still better protection is obtained when the particles of the luminescent layer on the recessed portion are each individually provided with a protective layer.

The supply of a lighting unit according to the invention is accommodated, for example, in a housing which is fastened to the discharge vessel and which also supports a lamp cap. Such a lighting unit is suitable as a replacement of an incandescent lamp. In a modification, the discharge vessel is detachably fastened to the housing, so that it can be replaced with another discharge vessel, for example a discharge vessel which radiates light of a different colour temperature during operation. Alternatively, a lighting unit according to the invention may be formed, for example, from an assembly of an electrodeless low-pressure discharge lamp according to the invention and a supply, the lamp being connected to the supply, for example, by means of a coax cable. The coax cable may, for example, be passed through a ferrite sleeve to prevent interference by high-frequency electromagnetic fields.

BRIEF DESCRIPTION OF THE DRAWINGS

These and other aspects of the invention will be explained in more detail with reference to a drawing. The FIGURE therein shows an embodiment of a lighting unit according to the invention, partly in elevation and partly in longitudinal sectional view.

DESCRIPTION OF THE PREFERRED EMBODIMENTS

The lighting unit shown in the FIGURE comprises an electrodeless low-pressure discharge lamp 10 and a high-frequency supply 40. The lamp 10 is provided with a discharge vessel 20 which is closed in a gastight manner and contains an ionizable filling, here a filling of mercury and argon. The discharge vessel 20 has a pear-shaped enveloping portion 21 and a tubular recessed portion 22 which is surrounded by the enveloping portion and which is connected to this enveloping portion 21 via a flared portion 23. The enveloping 21 and recessed 22 portions of the discharge vessel 20 support luminescent layers 24, 25. The electrodeless low-pressure discharge lamp 10 is in addition provided with a coil 30 with a core 31 of soft-magnetic material, here NiZn ferrite, which is arranged in the recessed portion 22 of the discharge vessel 20. The core has a length of 50 mm and a diameter of 12 mm. A heat pipe is accommodated in a cavity of 6 mm diameter, extends to outside the discharge vessel, and is fastened with good thermal conduction to a metal plate which serves as a heat sink (not shown). The coil 30 is electrically connected to the supply 40 via electrical conductors $\mathbf{32}_A$, $\mathbf{32}_B$. A high-frequency magnetic field is generated by the coil 30 during nominal operation so as to maintain an electrical discharge in the discharge space 26. The supply 40 is accommodated in a housing 41 fastened to the discharge vessel 20 of the lamp 10. The housing 41 supports a lamp cap 42 with electrical contacts $\mathbf{43}_A$, $\mathbf{43}_B$, to which the supply 40 is connected.

The luminescent layer 24 on the enveloping portion 21 of the discharge vessel 20 of the lighting unit 10 according to the invention (A) comprises 6.3% by weight of barium-magnesium aluminate activated by bivalent europium (BAM), 34.3% by weight of cerium-magnesium aluminate activated by trivalent terbium (CAT), and 59.4% by weight of yttrium oxide activated by trivalent europium (YOX). The maxima ($\lambda_{max}$) of the emission spectra of the materials BAM, CAT and YOX lie at 447, 541, and 610 nm, respectively. The conversion efficiency of the luminescent layer 24 on the enveloping portion 21 is 42.3%. The luminescent layer 25 on the recessed portion 22 comprises exclusively luminescent material of the CAT type having a conversion efficiency of 43.0%, i.e. higher than that of the luminescent layer 24 on the enveloping portion 21. The luminescent material YOX ($\lambda_{max}$=610 nm), which has a comparatively low conversion efficiency, is present exclusively on the enveloping portion 21 of the discharge vessel 20. Three of these lighting units (A) were manufactured.

Two lighting units (B) according to the invention were also manufactured where the luminescent layer on the recessed portion comprised exclusively luminescent material of the BAM type with a conversion efficiency of 52%. The luminescent layer on the enveloping portion is of the same composition as that on the enveloping portion of the lamps of type A. The luminescent material BAM ($\lambda$max= 447 nm), which has a comparatively high conversion efficiency, is accordingly present mainly on the recessed portion.

For comparison, three lighting units (C) were manufactured whose luminescent layers on the recessed portion were composed of 77% by weight of YOX and 23% by weight of CAT, having a conversion efficiency of 42.2%. This conversion efficiency is lower than that of the luminescent layer on the enveloping portion. The latter is of the same composition as the luminescent layer on the enveloping portions of the lamps of types A and B.

Apart from the compositions of the luminescent layers on the recessed and enveloping portions, the lighting units A, B and C are identical. The coating weight of the luminescent layer on the recessed portion was 8 mg/cm$^2$ in all cases, and the coating weight on the enveloping portion was 3.2 mg/cm$^2$.

The temperature (Tc in °C.) at the coil surface in the centre relative to the ends thereof was measured during operation for the lamps mentioned above (A, B, C). The results are shown in the Table The average value ($Tc_{av}$ in °C.) of the temperatures of the coil (Tc) ) measured for the lighting units is also given for each lamp type, as is the conversion efficiency ($\eta_c$ in %) of the luminescent layer on the recessed portion.

| Lighting unit | $\eta_c$ (%) | Tc (°C.) | $Tc_{av}$ (°C.) |
|---|---|---|---|
| A | 43 | 245 | 245 |
| | | 244 | |
| | | 245 | |
| B | 52 | 232 | 232 |
| | | 231 | |
| C | 42.2 | 253 | 250 |
| | | 246 | |
| | | 251 | |

The coil has a lower temperature Tc in the lighting units according to the invention. Although there is only a small positive difference between the conversion efficiency of the recessed portion and that of the enveloping portion (43% versus 42.3%) in lighting units of the type A, nevertheless a comparatively great reduction in the temperature of the recessed portion is realised. The average value $Tc_{av}$ of the coil temperature is approximately 5° lower than in reference lamps C. The average value $Tc_{av}$ in lighting units of type B is even 18° lower than in lighting units of type C.

Experiments have shown that lighting units whose luminescent layers on the recessed portion comprise more than 50% of weight of the luminescent material CAT ignite comparatively quickly compared with lighting units in which said luminescent layers have a lower percentage by weight of the luminescent material CAT.

We claim:

1. A lighting unit comprising an electrodeless low-pressure discharge lamp and a high-frequency supply which electrodeless low-pressure discharge lamp is provided with a discharge vessel which is closed in a gastight manner, has an ionizable filling, and comprises an enveloping portion and a recessed portion surrounded by said enveloping portion, the enveloping and the recessed portion of the discharge vessel each supporting a luminescent layer, and which electrodeless low-pressure discharge lamp is in addition provided with a coil arranged in the recessed portion of the discharge vessel and electrically connected to the supply, characterized in that the conversion efficiency of the luminescent layer on the recessed portion is relatively high compared with that of the luminescent layer on the enveloping portion.

2. A lighting unit as claimed in claim 1, characterized in that the coil surrounds a core of soft-magnetic material.

3. A lighting unit as claimed in claim 2, characterized in that luminescent material whose emission spectrum has a maximum at a wavelength of at least 600 nm is mainly present in the luminescent layer of the enveloping portion.

4. A lighting unit as claimed in claim 3, characterized in that luminescent material whose emission spectrum has a maximum at a wavelength of at most 500 nm is mainly present in the luminescent layer of the recessed portion.

5. A lighting unit as claimed in claim 4, characterized in that the luminescent layer of the recessed portion lies on a reflecting layer.

6. A lighting unit as claimed in claim 5, characterized in that the discharge vessel has an ionizable filling of mercury and a rare gas, and in that the luminescent layer on the recessed portion comprises at least 50% by weight of cerium-magnesium aluminate activated by trivalent terbium.

7. A lighting unit as claimed in claim 6, characterized in that the luminescent layer on the recessed portion carries a protective layer made of a metal oxide.

8. A lighting unit as claimed in claim 6, characterized in that the particles of the luminescent layer on the recessed portion are each individually provided with a protective layer.

9. An electrodeless low-pressure discharge lamp which comprises:

a discharge vessel which is closed in a gastight manner, having an ionizable filling, an enveloping portion and a recessed portion surrounded by the enveloping portion, the enveloping portion and the recessed portion each supporting a luminescent layer:

a coil arranged in the recessed portion of the discharge vessel and electrically connected to a high frequency supply, wherein the conversion efficiency of the luminescent layer on the recessed portion is relatively high compared with that of the luminescent layer on the enveloping portion.

10. A discharge vessel having a gastight construction and an ionizable filling, which comprises:

an enveloping portion: and a recessed portion surrounded by the enveloping portion, the enveloping portion and the recessed portion each supporting a luminescent layer, wherein the conversion efficiency of the luminescent layer on the recessed portion is relatively high compared with that of the luminescent layer on the enveloping portion.

11. A lighting unit as claimed in claim 1, characterized in that luminescent material whose emission spectrum has a maximum at a wavelength of at least 600 nm is mainly present in the luminescent layer of the enveloping portion.

12. A lighting unit as claimed in claim 2, characterized in that luminescent material whose emission spectrum has a maximum at a wavelength of at most 500 nm is mainly present in the luminescent layer of the recessed portion.

13. A lighting unit as claimed in claim 1, characterized in that luminescent material whose emission spectrum has a maximum at a wavelength of at most 500 nm is mainly present in the luminescent layer of the recessed portion.

14. A lighting unit as claimed in claim 3, characterized in that the luminescent layer of the recessed portion lies on a reflecting layer.

15. A lighting unit as claimed in claim 2, characterized in that the luminescent layer of the recessed portion lies on a reflecting layer.

16. A lighting unit as claimed in claim 1, characterized in that the luminescent layer of the recessed portion lies on a reflecting layer.

17. A lighting unit as claimed in claim 1, characterized in that the discharge vessel has an ionizable filling of mercury and a rare gas, and in that the luminescent layer on the recessed portion comprises at least 50% by weight of cerium-magnesium aluminate activated by trivalent terbium.

18. A lighting unit as claimed in claim 1, characterized in that the luminescent layer on the recessed portion carries a protective layer made of a metal oxide.

19. A lighting unit as claimed in claim 1, characterized in that the particles of the luminescent layer on the recessed portion are each individually provided with a protective layer.

* * * * *